US010221621B2

(12) United States Patent
Marcinik et al.

(10) Patent No.: US 10,221,621 B2
(45) Date of Patent: Mar. 5, 2019

(54) ROLLER SHADE LATCHING APPARATUS

(71) Applicant: Crestron Electronics, Inc., Rockleigh, NJ (US)

(72) Inventors: Robert Marcinik, Wallkill, NY (US); David Paolazzi, North Arlington, NJ (US)

(73) Assignee: Crestron Electronics, Inc., Rockleigh, NJ (US)

( * ) Notice: Subject to any disclaimer, the term of this patent is extended or adjusted under 35 U.S.C. 154(b) by 232 days.

(21) Appl. No.: 15/404,845

(22) Filed: Jan. 12, 2017

(65) Prior Publication Data

US 2017/0204659 A1 Jul. 20, 2017

Related U.S. Application Data

(60) Provisional application No. 62/279,225, filed on Jan. 15, 2016.

(51) Int. Cl.

| | |
|---|---|
| ***A47H 1/13*** | (2006.01) |
| ***E06B 9/50*** | (2006.01) |
| ***E06B 9/174*** | (2006.01) |

(52) U.S. Cl.

CPC ..... *E06B 9/50* (2013.01); *E06B 9/174* (2013.01)

(58) Field of Classification Search

CPC ... E06B 9/50; E06B 9/174; A47H 1/13; Y10T 292/0911; Y10T 292/0926; Y10T 292/0928; Y10T 292/0934; Y10T 292/1043; Y10T 292/1051; Y10T 292/1052

USPC ..... 160/368.1, 323.1, 324, 325, 903; 248/266, 267, 268, 269, 221.11, 222.11; 292/11, 13, 17, 18, 19, 44, 56, 76, 78, 292/121, 122, 123, 126, 240, 241, 242, 292/219, 220, 221, 223, 226, 227, 228, 292/304, 303

See application file for complete search history.

(56) References Cited

U.S. PATENT DOCUMENTS

| | | | | | |
|---|---|---|---|---|---|
| 1,197,826 | A * | 9/1916 | Jones | A47H 1/13 | 248/255 |
| 1,302,292 | A * | 4/1919 | Blake | A47H 1/13 | 248/252 |
| 1,349,933 | A * | 8/1920 | Zeitz | A47H 1/13 | 248/255 |
| 1,431,092 | A * | 10/1922 | Benham | A47H 1/13 | 248/259 |

(Continued)

*Primary Examiner* — Katherine W Mitchell
*Assistant Examiner* — Johnnie A Shablack
(74) *Attorney, Agent, or Firm* — Crestron Electronics, Inc.

(57) ABSTRACT

A latching apparatus includes a latching frame, at least one latching member, and at least one spring that exerts a force that drives a curved part of the latching member about a pivot toward a guiding edge of an end portion of the latching frame. A guiding edge of the latching member guides an external mounting pin toward an opening, formed by the curved part of the latching member and the guiding edge of the end portion of the latching frame, when the mounting pin is pushed against the guiding edge of the latching member. The pin initially causes the latching member to pivot away from the end portion until the pin slides past the guiding edge of the latching member and is secured between the curved part of the latching member and the guiding edge of the end portion by the force exerted by the spring.

12 Claims, 4 Drawing Sheets

(56) References Cited

U.S. PATENT DOCUMENTS 1,533,709 A * 4/1925 Saksa ..... A47H 1/13 248/260
1,549,505 A * 8/1925 Rasmussen ..... E05B 65/0092 292/25
1,688,223 A * 10/1928 Bailey ..... A47H 1/13 248/255
1,831,299 A * 11/1931 Geske ..... E05C 3/167 292/226
1,952,704 A * 3/1934 Eberhardt ..... E06B 9/54 160/28
1,985,567 A * 12/1934 Haefele ..... E06B 9/50 24/331
2,030,960 A * 2/1936 Burns ..... E06B 9/305 160/176.1 R
2,105,469 A * 1/1938 Bosch, Jr. ..... E06B 9/54 160/296
2,112,206 A * 3/1938 Clavey ..... E06B 9/50 160/120
2,155,944 A * 4/1939 Lewis ..... E06B 9/307 160/174 R
2,155,945 A * 4/1939 Lewis ..... E06B 9/324 160/178.2
2,179,162 A * 11/1939 Richardson ..... E21B 19/081 248/646
2,420,977 A * 5/1947 Pye ..... E06B 9/50 160/324
2,426,498 A * 8/1947 Franklin ..... B25B 5/08 248/509
2,448,481 A * 8/1948 Wise ..... E06B 9/50 160/324
2,689,607 A * 9/1954 Loucony ..... E06B 9/305 160/177 R
3,103,995 A * 9/1963 Dugger ..... E05B 65/0021 292/341.17
3,169,574 A * 2/1965 Behlen ..... E05D 15/0665 16/106
3,298,134 A * 1/1967 Overby ..... E06B 11/02 292/341.17
3,572,790 A * 3/1971 Kapanka ..... E05B 83/24 292/125
3,578,368 A * 5/1971 Dupuis ..... B41J 29/387 292/216
3,719,220 A * 3/1973 Small ..... A47H 2/00 160/108
3,998,482 A * 12/1976 Nozaki ..... E05B 85/243 292/216
4,249,714 A * 2/1981 Boyle ..... E06B 9/50 248/254
4,529,351 A * 7/1985 Olins ..... B60P 1/4421 292/31
4,538,785 A * 9/1985 Damsgaard ..... E06B 9/50 248/268
4,773,693 A * 9/1988 Premji ..... B60N 2/01583 292/11
4,871,138 A * 10/1989 Sauter ..... F16B 7/105 248/408
4,949,926 A * 8/1990 Liu ..... E06B 9/323 16/94 R
4,973,091 A * 11/1990 Paulson ..... E05O 9/041 292/216
5,022,691 A * 6/1991 Clay, Jr. ..... E05C 3/30 292/121
5,078,197 A * 1/1992 Weishar ..... E06B 9/17046 160/133
5,192,096 A * 3/1993 Weinerman ..... E05C 3/34 292/45
5,209,530 A * 5/1993 Kolloch ..... E05O 3/165 292/244
5,342,103 A * 8/1994 Tame ..... B60N 2/366 292/246
5,348,355 A * 9/1994 Oyha ..... E05B 83/16 292/11
5,516,162 A * 5/1996 Takaishi ..... E05B 63/127 292/34
5,544,924 A * 8/1996 Paster ..... E05B 15/0006 160/201
5,868,446 A * 2/1999 Rossmo ..... E05B 15/0006 292/122
5,951,068 A * 9/1999 Strong ..... E05B 65/0858 292/112
6,012,747 A * 1/2000 Takamura ..... B60N 2/366 292/210
6,027,148 A * 2/2000 Shoemaker ..... E05B 47/0002 292/201
6,174,003 B1 * 1/2001 Smart ..... E05B 63/127 292/109
6,322,029 B1 * 11/2001 Sonnenberg ..... E06B 9/323 248/201
6,347,819 B1 * 2/2002 Plaxco ..... E05B 65/0007 292/228
6,371,424 B1 * 4/2002 Shaw ..... F16M 11/041 248/187.1
6,474,118 B2 * 11/2002 Martinez ..... E05B 63/0013 292/129
6,543,821 B1 * 4/2003 Weinerman ..... E05B 13/105 292/123
6,598,896 B1 * 7/2003 Hyslop ..... B60P 3/10 280/414.1
6,755,449 B2 * 6/2004 Weinerman ..... E05B 13/105 292/198
6,848,662 B2 * 2/2005 Paramonoff ..... E05C 3/14 248/222.11
6,907,964 B2 * 6/2005 Savard ..... E05D 13/1261 160/191
6,962,375 B2 * 11/2005 Linares ..... E05C 3/24 292/201
7,032,973 B2 * 4/2006 Reubeuze ..... B60N 2/01541 292/121
7,040,671 B2 * 5/2006 Su ..... E05B 63/0013 292/116
7,267,311 B2 * 9/2007 Jung ..... E06B 9/50 160/903
7,497,103 B1 * 3/2009 Misner ..... E05B 63/14 292/129
7,506,850 B2 * 3/2009 Chang ..... F16M 11/041 248/221.11
7,513,541 B1 * 4/2009 Gregory ..... E05C 3/24 292/198
7,523,529 B2 * 4/2009 Yang ..... G06F 1/1605 24/609
7,559,584 B2 * 7/2009 Rebel ..... E05B 63/0056 292/25
7,604,265 B2 * 10/2009 Tsai ..... E05B 65/0858 292/116
7,637,302 B2 * 12/2009 Drew ..... E06B 9/323 160/173 R
7,677,294 B2 * 3/2010 Bohlen ..... E06B 9/50 160/323.1
7,740,047 B2 * 6/2010 Koop ..... E06B 9/50 160/323.1
7,837,241 B2 * 11/2010 Chung ..... E05B 63/185 292/199
7,861,976 B2 * 1/2011 Holemans ..... B63B 21/08 244/119
8,002,013 B2 * 8/2011 Brown ..... F24F 13/14 160/351
8,151,859 B2 * 4/2012 Koop ..... E06B 9/50 160/325
8,220,520 B2 * 7/2012 Lukos ..... E04F 10/0662 160/242
8,480,526 B2 * 7/2013 Nicholson ..... E06B 9/174 475/149
8,579,004 B2 * 11/2013 Cannaverde ..... E06B 9/174 160/120
8,602,464 B2 * 12/2013 Yadollahi ..... E05B 51/023 292/194
8,672,115 B1 * 3/2014 Jennings ..... E06B 9/56 160/298

(56) References Cited

U.S. PATENT DOCUMENTS 8,678,451 B2 * 3/2014 Martin ..... E05C 3/14 292/121
8,695,681 B2 * 4/2014 Daniels ..... E06B 9/50 160/291
8,827,225 B2 * 9/2014 Andersson ..... G09F 7/18 248/309.1
8,839,841 B2 * 9/2014 Koop ..... E06B 9/50 160/325
8,876,171 B2 * 11/2014 Schendel ..... E05B 41/00 292/116
8,925,890 B2 * 1/2015 Liaw ..... G10G 5/00 211/85.6
8,967,568 B2 * 3/2015 Wills ..... E06B 9/50 160/323.1
9,060,636 B2 * 6/2015 Cannaverde ..... E06B 9/174
9,117,351 B2 * 8/2015 Gulick, Jr. ..... G08B 13/149
9,206,640 B1 * 12/2015 Jennings ..... E06B 9/56
9,206,641 B2 * 12/2015 Feldstein ..... E06B 9/50
9,255,429 B2 * 2/2016 Kim, II ..... E05B 83/24
9,370,294 B2 * 6/2016 Osvatic ..... A47L 15/4259
9,500,012 B2 * 11/2016 Yamazaki ..... B60N 2/01583
9,710,016 B1 * 7/2017 Porzio ..... G06F 1/1632
9,771,740 B2 * 9/2017 Karcz ..... E05B 65/0007
9,784,020 B2 * 10/2017 Kwon ..... E05B 83/24
9,961,425 B2 * 5/2018 Wan ..... H04R 1/026
2002/0056296 A1 * 5/2002 Weinerman ..... E05B 13/105 70/79
2003/0030287 A1 * 2/2003 Fisher ..... E05B 85/26 292/216
2003/0116973 A1 * 6/2003 Liu ..... E05B 63/0013 292/26
2004/0020609 A1 * 2/2004 Savard ..... B25B 13/46 160/133
2004/0145189 A1 * 7/2004 Liu ..... E05B 63/0013 292/24
2004/0195841 A1 * 10/2004 Liu ..... E05B 63/0013 292/24
2005/0183835 A1 * 8/2005 Nien ..... E06B 9/50 160/321
2005/0279890 A1 * 12/2005 Holemans ..... B63B 21/08 244/171.3
2006/0071478 A1 * 4/2006 Denys ..... E05B 63/12 292/26
2006/0091679 A1 * 5/2006 Tsai ..... E05B 65/0858 292/24
2007/0120031 A1 * 5/2007 Rasmussen ..... E06B 9/50 248/266
2007/0200355 A1 * 8/2007 Liang ..... E05B 65/0858 292/24
2007/0290511 A1 * 12/2007 Liang ..... E05B 65/0858 292/24
2007/0295042 A1 * 12/2007 Sattler ..... B60N 2/20 70/237
2008/0258475 A1 * 10/2008 Chung ..... E05B 63/185 292/25
2009/0025439 A1 * 1/2009 Pitschke ..... B60R 25/04 70/237
2009/0199605 A1 * 8/2009 Spurr ..... E05B 81/14 70/266
2010/0000690 A1 * 1/2010 Yang ..... G03B 21/58 160/127
2010/0026013 A1 * 2/2010 Otsuka ..... B60N 2/01583 292/121
2010/0072761 A1 * 3/2010 Tomaszewski ..... E05B 77/26 292/201
2010/0148523 A1 * 6/2010 Tai ..... E05B 17/2038 292/236
2010/0263811 A1 * 10/2010 Gao ..... E06B 9/266 160/368.1
2011/0139381 A1 * 6/2011 Daniels ..... E06B 9/50 160/298
2012/0160975 A1 * 6/2012 Cannaverde ..... E06B 9/174 248/208
2013/0319624 A1 * 12/2013 Cannaverde ..... E06B 9/174 160/405
2014/0103666 A1 * 4/2014 Yamazaki ..... B60N 2/01583 292/121
2014/0138961 A1 * 5/2014 Hwang ..... E05B 83/24 292/122
2014/0230502 A1 * 8/2014 Karcz ..... E05B 65/0007 70/357
2015/0007949 A1 * 1/2015 Daniels ..... E06B 9/50 160/323.1
2015/0041611 A1 * 2/2015 Mueller ..... B60N 2/01583 248/503.1
2015/0083351 A1 * 3/2015 Campagna ..... E06B 9/50 160/310
2015/0191938 A1 * 7/2015 Karcz ..... E05B 65/0007 70/101
2015/0218856 A1 * 8/2015 Sayama ..... E05B 79/08 292/96
2015/0345216 A1 * 12/2015 Feldstein ..... E06B 9/50 160/310
2015/0376922 A1 * 12/2015 Weinerman ..... E05C 3/24 70/344
2017/0037658 A1 * 2/2017 Karcz ..... E05B 65/0007
2017/0159359 A1 * 6/2017 Vries ..... E06B 9/44
2017/0204659 A1 * 7/2017 Marcinik ..... E06B 9/174
2017/0234037 A1 * 8/2017 Cassou ..... E05C 19/022 292/163
2017/0247943 A1 * 8/2017 Ng ..... E06B 9/42
2017/0260806 A1 * 9/2017 Adams ..... E06B 9/32
2017/0321842 A1 * 11/2017 Daniels ..... E06B 9/50
2018/0023340 A1 * 1/2018 Goldberg ..... E06B 9/56
2018/0081403 A1 * 3/2018 Owens ..... G06F 1/1632
2018/0142518 A1 * 5/2018 Ng ..... E06B 9/50
2018/0171708 A1 * 6/2018 Alonso Fabregat .... E06B 9/174

* cited by examiner

ROLLER SHADE LATCHING APPARATUS

CROSS-REFERENCE TO RELATED APPLICATIONS

This application claims the benefit of the filing date of U.S. Provisional Patent Application No. 62/279,225, filed Jan. 15, 2016, the disclosure of which is incorporated herein by reference.

BACKGROUND OF THE INVENTION

Technical Field

The present embodiments relates generally to roller shade latching, and more particularly to a roller shade latching apparatus that couples to a shade mounting bracket using spring-loaded latching members.

Background Art

Roller shades are typically hung in place over a window using simple hooks. Gravity is the force that holds the roller shade in place. Due to rotational forces, the roller shade can move and cause noise. Further, to remove or unhang the roller shade, the roller shade must be lifted up to disengage the hooks. Lifting a large diameter shade up to disengage the hooks can be difficult due to the lack of space between the shade and ceiling (i.e., head room).

It is therefore desirable to provide a roller shade latching apparatus that more securely holds the roller shade in place and which can more readily engage and disengage the roller shade.

SUMMARY OF THE INVENTION

It is to be understood that both the general and detailed descriptions that follow are exemplary and explanatory only and are not restrictive.

DISCLOSURE OF INVENTION

In accordance with an aspect, a latching apparatus, comprises: (a) a latching frame having at least one end portion that includes a guiding edge; (b) at least one latching member having a curved part and a guiding edge located at an outer end of the curved part, and being coupled at a pivot to the end portion such that the guiding edge and the curved part of the latching member face the guiding edge of the end portion, the curved part of the latching member and the guiding edge of the end portion forming an opening; and (c) at least one spring coupled at one end to the latching member such that the spring exerts a force that drives the curved part of the latching member about the pivot toward the guiding edge of the end portion; wherein (d) the guiding edge of the latching member is configured to guide an external mounting pin toward the opening in response to the mounting pin being pushed against the guiding edge of the latching member whereby the mounting pin initially causes the latching member to pivot away from the end portion until the mounting pin slides past the guiding edge of the latching member and is secured between the curved part of the latching member and the guiding edge of the end portion by the force exerted by the spring.

According to another aspect, a latching apparatus, comprises: (a) a latching frame that includes a first end portion located at one end of the latching frame and a second end portion located at another end of the latching frame, each having a respective guiding edge; (b) a first latching member having a curved part and a guiding edge located at an outer end of the curved part, the first latching member being coupled at a first pivot to the first end portion such that the guiding edge and the curved part of the first latching member face the guiding edge of the first end portion, the curved part of the first latching member and the guiding edge of the first end portion forming a first opening; (c) a first spring coupled at one end to the first latching member and at another end to the first end portion such that the first spring exerts a force that drives the curved part of the first latching member about the first pivot toward the guiding edge of the first end portion, (d) a second latching member having a curved part and a guiding edge located at an outer end of the curved part, the second latching member being coupled at a second pivot to the second end portion such that the guiding edge and the curved part of the second latching member face the guiding edge of the second end portion, the curved part of the second latching member and the guiding edge of the second end portion forming a second opening; (e) a second spring coupled at one end to the second latching member and at another end to the second end portion such that the second spring exerts a force that drives the curved part of the second latching member about the second pivot toward the guiding edge of the second end portion; wherein (f) the guiding edge of the first latching member is configured to guide a first mounting pin of an external bracket toward the first opening in response to the first mounting pin being pushed against the guiding edge of the first latching member whereby the first mounting pin initially causes the first latching member to pivot away from the first end portion until the first mounting pin slides past the guiding edge of the first latching member and is secured between the curved part of the first latching member and the guiding edge of the first end portion by the force exerted by the first spring, and (g) the guiding edge of the second latching member is configured to guide a second mounting pin of the external bracket toward the second opening in response to the second mounting pin being pushed against the guiding edge of the second latching member whereby the second mounting pin initially causes the second latching member to pivot away from the second end portion until the second mounting pin slides past the guiding edge of the second latching member and is secured between the curved part of the second latching member and the guiding edge of the second end portion by the force exerted by the second spring.

According to a further aspect, a latching apparatus, comprises: (a) a latching frame that includes a first end portion located at one end of the latching frame and a second end portion located at another end of the latching frame, each having a respective guiding edge; (b) a first latching member having a curved part and a guiding edge located at an outer end of the curved part, the first latching member being coupled at a first pivot to the first end portion such that the guiding edge and the curved part of the first latching member face the guiding edge of the first end portion, the curved part of the first latching member and the guiding edge of the first end portion forming a first opening; (c) a second latching member having a curved part and a guiding edge located at an outer end of the curved part, the second latching member being coupled at a second pivot to the second end portion such that the guiding edge and the curved part of the second latching member face the guiding edge of the second end portion, the curved part of the second latching member and the guiding edge of the second end portion forming a second opening; (d) a spring coupled at one end to the first latching member and at another end to the second latching member such that the spring exerts a force that drives the curved part of the first latching member about the first pivot toward the guiding edge of the first end portion and drives the curved part of the second latching member about the second pivot toward the guiding edge of the second end portion; wherein (e) the guiding edge of the first latching member is configured to guide a first mounting pin of an external bracket toward the first opening in response to the first mounting pin being pushed against the guiding edge of the first latching member whereby the first mounting pin initially causes the first latching member to pivot away from the first end portion until the first mounting pin slides past the guiding edge of the first latching member and is secured between the curved part of the first latching member and the guiding edge of the first end portion by the force exerted by the spring, and (f) the guiding edge of the second latching member is configured to guide a second mounting pin of the external bracket toward the second opening in response to the second mounting pin being pushed against the guiding edge of the second latching member whereby the second mounting pin initially causes the second latching member to pivot away from the second end portion until the second mounting pin slides past the guiding edge of the second latching member and is secured between the curved part of the second latching member and the guiding edge of the second end portion by the force exerted by the spring.

According to yet another aspect, a latching system, comprises: (a) a bracket including a first mounting pin and a second mounting pin; and (b) a latching apparatus, comprising: (i) a latching frame that includes a first end portion located at one end of the latching frame and a second end portion located at another end of the latching frame, each having a respective guiding edge, (ii) a first latching member having a curved part and a guiding edge located at an outer end of the curved part, the first latching member being coupled at a first pivot to the first end portion such that the guiding edge and the curved part of the first latching member face the guiding edge of the first end portion, the curved part of the first latching member and the guiding edge of the first end portion forming a first opening, (iii) a first spring coupled at one end to the first latching member and at another end to the first end portion such that the first spring exerts a force that drives the curved part of the first latching member about the first pivot toward the guiding edge of the first end portion, (iv) a second latching member having a curved part and a guiding edge located at an outer end of the curved part, the second latching member being coupled at a second pivot to the second end portion such that the guiding edge and the curved part of the second latching member face the guiding edge of the second end portion, the curved part of the second latching member and the guiding edge of the second end portion forming a second opening, (v) a second spring coupled at one end to the second latching member and at another end to the second end portion such that the second spring exerts a force that drives the curved part of the second latching member about the second pivot toward the guiding edge of the second end portion, wherein (vi) the guiding edge of the first latching member is configured to guide the first mounting pin of the bracket toward the first opening in response to the first mounting pin being pushed against the guiding edge of the first latching member whereby the first mounting pin initially causes the first latching member to pivot away from the first end portion until the first mounting pin slides past the guiding edge of the first latching member and is secured between the curved part of the first latching member and the guiding edge of the first end portion by the force exerted by the first spring, and (vii) the guiding edge of the second latching member is configured to guide the second mounting pin of the bracket toward the second opening in response to the second mounting pin being pushed against the guiding edge of the second latching member whereby the second mounting pin initially causes the second latching member to pivot away from the second end portion until the second mounting pin slides past the guiding edge of the second latching member and is secured between the curved part of the second latching member and the guiding edge of the second end portion by the force exerted by the second spring.

According to a still further aspect, a latching system, comprises: (a) a bracket including a first mounting pin and a second mounting pin; and (b) a latching apparatus, comprising: (i) a latching frame that includes a first end portion located at one end of the latching frame and a second end portion located at another end of the latching frame, each having a respective guiding edge; (ii) a first latching member having a curved part and a guiding edge located at an outer end of the curved part, the first latching member being coupled at a first pivot to the first end portion such that the guiding edge and the curved part of the first latching member face the guiding edge of the first end portion, the curved part of the first latching member and the guiding edge of the first end portion forming a first opening; (iii) a second latching member having a curved part and a guiding edge located at an outer end of the curved part, the second latching member being coupled at a second pivot to the second end portion such that the guiding edge and the curved part of the second latching member face the guiding edge of the second end portion, the curved part of the second latching member and the guiding edge of the second end portion forming a second opening; (iv) a spring coupled at one end to the first latching member and at another end to the second latching member such that the spring exerts a force that drives the curved part of the first latching member about the first pivot toward the guiding edge of the first end portion and drives the curved part of the second latching member about the second pivot toward the guiding edge of the second end portion; wherein (v) the guiding edge of the first latching member is configured to guide the first mounting pin of the bracket toward the first opening in response to the first mounting pin being pushed against the guiding edge of the first latching member whereby the first mounting pin initially causes the first latching member to pivot away from the first end portion until the first mounting pin slides past the guiding edge of the first latching member and is secured between the curved part of the first latching member and the guiding edge of the first end portion by the force exerted by the spring, and (vi) the guiding edge of the second latching member is configured to guide the second mounting pin of the bracket toward the second opening in response to the second mounting pin being pushed against the guiding edge of the second latching member whereby the second mounting pin initially causes the second latching member to pivot away from the second end portion until the second mounting pin slides past the guiding edge of the second latching member and is secured between the curved part of the second latching member and the guiding edge of the second end portion by the force exerted by the spring.

BRIEF DESCRIPTION OF DRAWINGS

The accompanying figures further illustrate the present embodiments.

The components in the drawings are not necessarily drawn to scale, emphasis instead being placed upon clearly illustrating the principles of the present embodiments. In the drawings, like reference numerals designate corresponding parts throughout the several views.

BRIEF DESCRIPTION OF THE SEVERAL VIEWS OF THE DRAWING

Figure 1A:
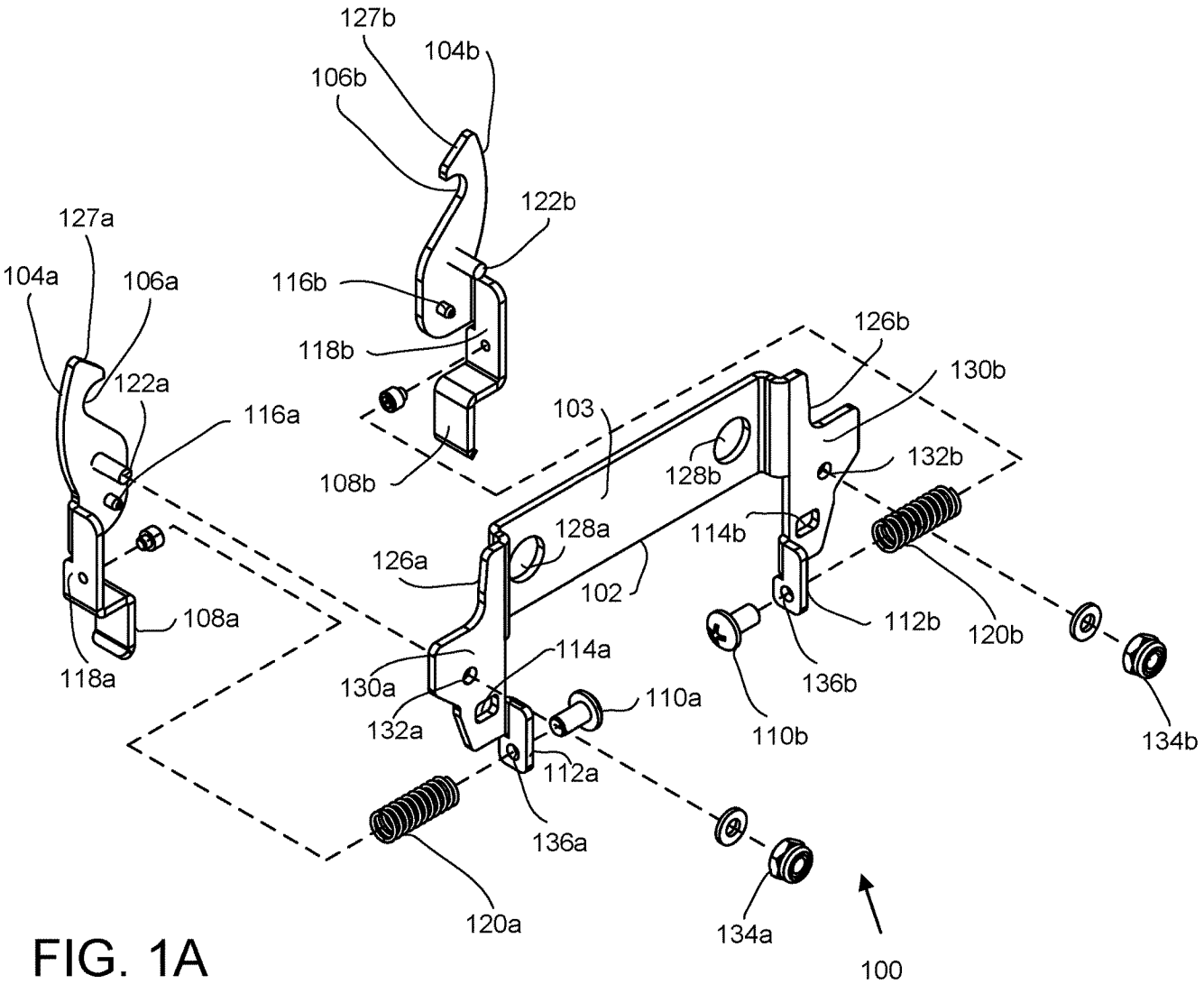
Figure 1B:
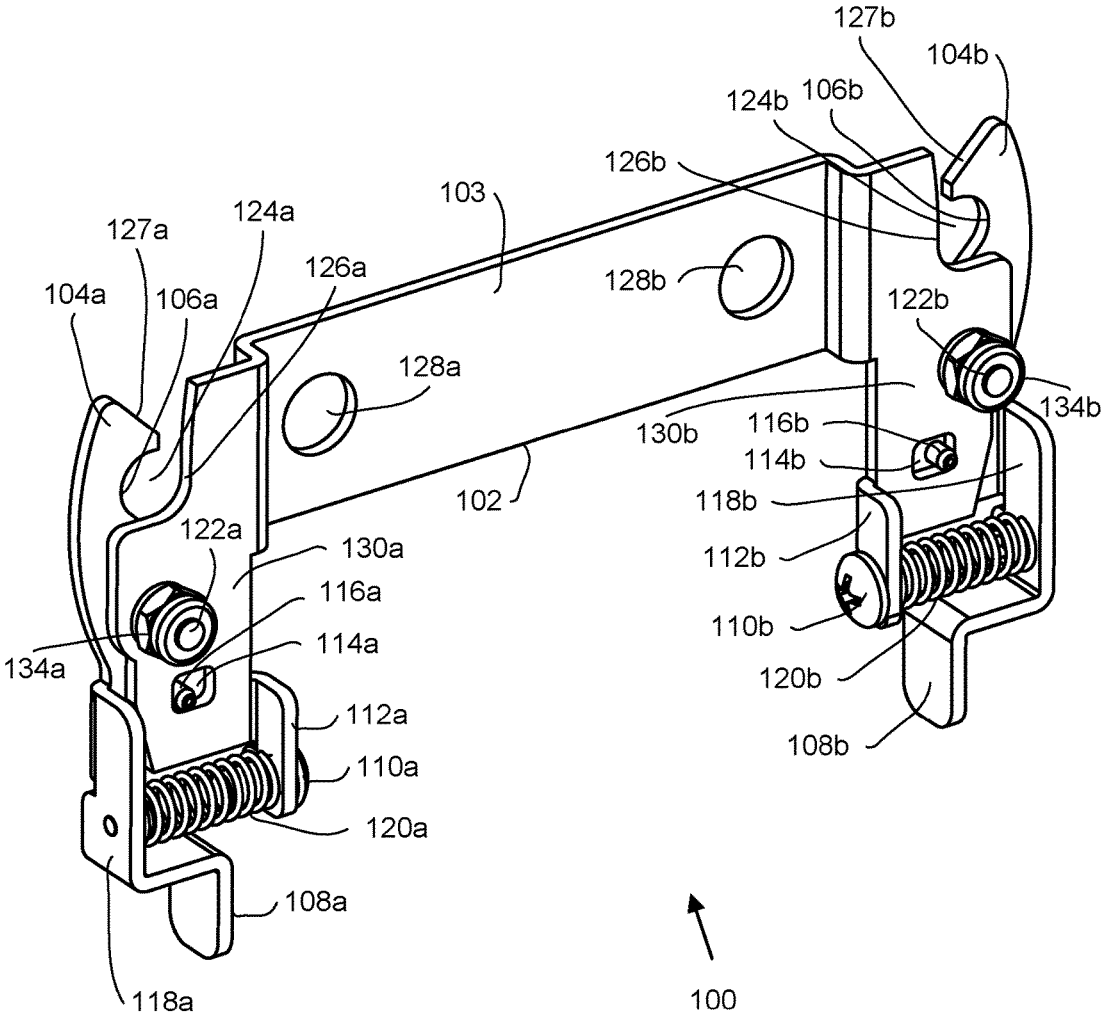

FIG. 1A is an exploded view of and FIG. 1B is an illustrative isometric projection of a shade latching apparatus, according to one embodiment.

Figure 2:
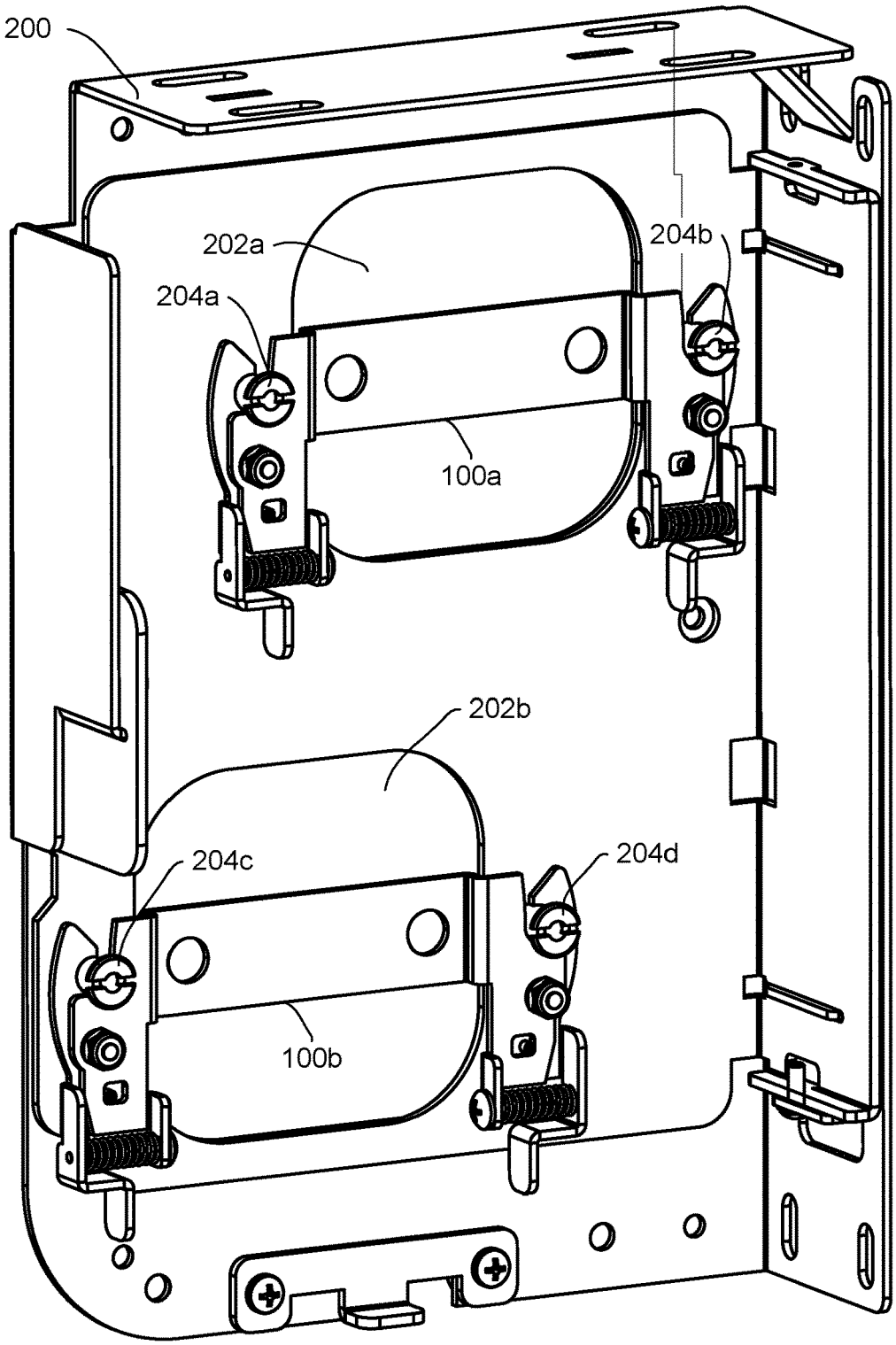

FIG. 2 is an illustrative isometric projection of a dual shade motor bracket with two shade latching apparatuses of FIGS. 1A-1B disposed therein, according to one embodiment.

Figure 3:
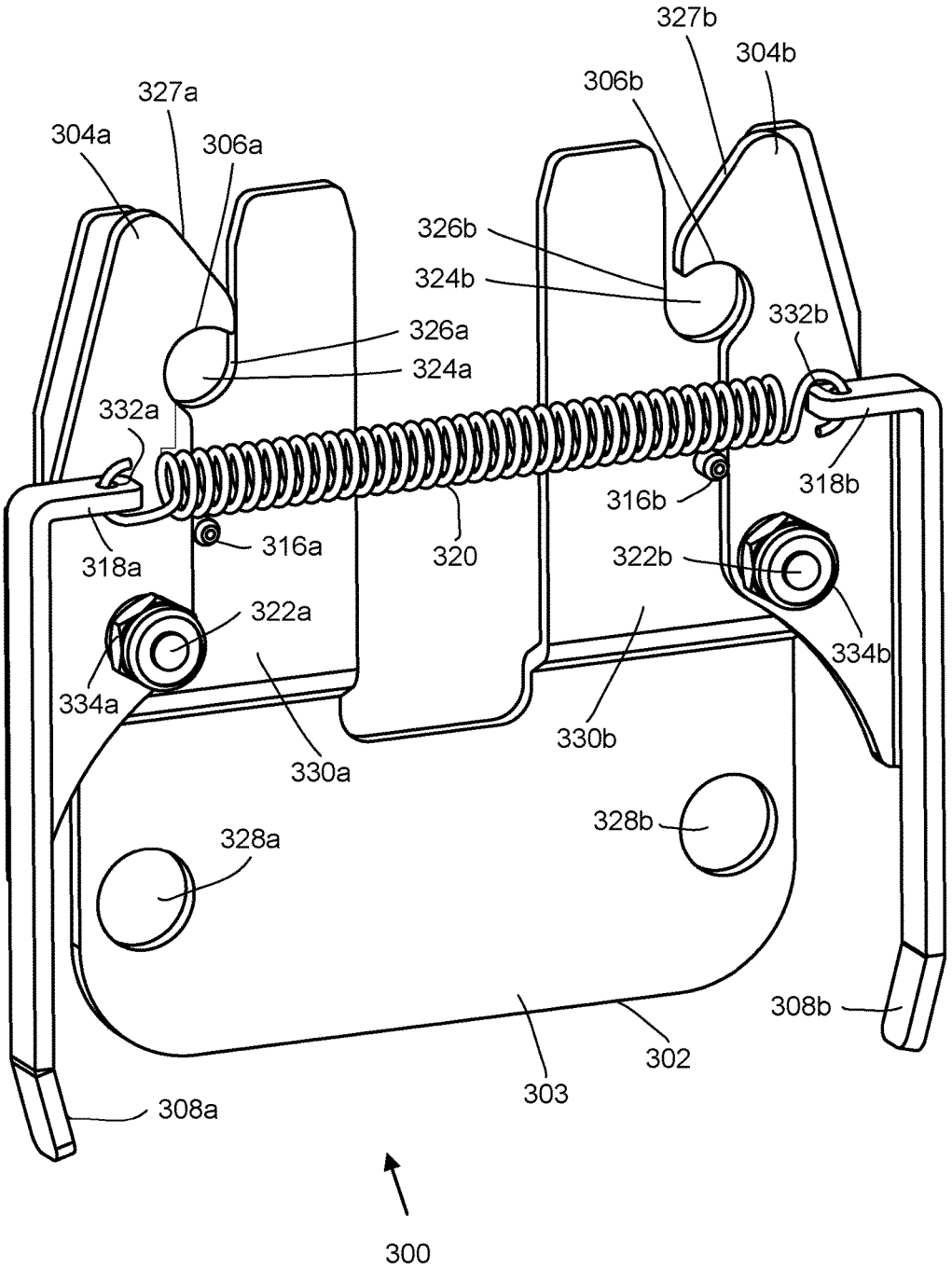

FIG. 3 is an illustrative isometric projection of a shade latching apparatus, according to another embodiment.

DETAILED DESCRIPTION OF THE INVENTION

Reference will now be made to the exemplary embodiments illustrated in the drawings, and specific language will be used herein to describe the same. It will nevertheless be understood that no limitation of the scope of the embodiments is thereby intended. Alterations and further modifications of the inventive features illustrated herein, and additional applications of the principles of the embodiments as illustrated herein, which would occur to one skilled in the relevant art and having possession of this disclosure, are to be considered within the scope of the embodiments.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to".

LIST OF REFERENCE NUMBERS FOR THE MAJOR ELEMENTS IN THE DRAWINGS

The following is a list of the major elements in the drawings in numerical order.

100 shade latching apparatus
102 latching frame
103 horizontal portion
104*a* left latching member
104*b* right latching member
106*a* left curved portion
106*b* right curved portion
108*a* left latching member actuating portion
108*b* right latching member actuating portion
110*a* left spring retention screw
110*b* right spring retention screw
112*a* left inside spring retention member
112*b* right inside spring retention member
114*a* left pin pocket stop
114*b* right pin pocket stop
116*a* left pin
116*b* right pin
118*a* left outside spring retention member
118*b* right outside spring retention member
120*a* left compression spring
120*b* right compression spring
122*a* left threaded pivot
122*b* right threaded pivot
124*a* left opening
124*b* right opening
126*a* left vertical portion guiding edge
126*b* right vertical portion guiding edge
127*a* left latching member guiding edge
127*b* right latching member guiding edge
128*a* left through hole
128*b* right through hole
130*a* left vertical portion
130*b* right vertical portion
132*a* left vertical portion through hole
132*b* right vertical portion through hole
134*a* nut
134*b* nut
136*a* threaded hole
136*b* threaded hole
200 dual shade motor bracket
202*a* first opening
202*b* second opening
204*a* first mounting pin
204*b* second mounting pin
204*c* third mounting pin
204*d* fourth mounting pin
300 shade latching apparatus
302 latch frame
303 horizontal portion
304*a* left latching member
304*b* right latching member
306*a* left curved portion
306*b* right curved portion
308*a* left latching member actuating portion
308*b* right latching member actuating portion
316*a* left pin
316*b* right pin
318*a* left spring retention member
318*b* right spring retention member
320 extension spring
322*a* left threaded pivot
322*b* right threaded pivot
324*a* left opening
324*b* right opening
326*a* left vertical portion guiding edge
326*b* right vertical portion guiding edge
327*a* left latching member guiding edge
327*b* right latching member guiding edge
328*a* left through hole
328*b* right through hole
330*a* left vertical portion
330*b* right vertical portion
332*a* left latching member through hole
332*b* right latching member through hole
334*a* nut
334*b* nut

MODE(S) FOR CARRYING OUT THE INVENTION

The embodiment described herein in the context of roller shade latching, but is not limited thereto, except as may be set forth expressly in the appended claims.

Disclosed is a roller shade latching apparatus or mechanism that includes one or more springs to positively hold the shade in place. The disclosed shade latching mechanism allows the shade to be placed (i.e., hung) over a window by simply pushing the shade up or in to engage the shade mounting bracket. The latch provides a crisp "snap" sound that indicates to the installer that the roller tube is in place. The geometry of the latch is such that the weight of the shade helps to provide more holding force. Removing the shade is accomplished by squeezing the latch brackets which allows the shade to disengage from the pins, as described in detail herein below.

Referring to FIGS. 1A-1B, in one embodiment, an illustrative exploded view of a shade latching apparatus/mechanism 100 is shown in FIG. 1A, and an illustrative isometric projection of the shade latching apparatus/mechanism 100 is shown in FIG. 1B. The latching mechanism 100 includes a latching frame 102, which includes a horizontal portion 103, a left vertical portion 130*a*, and a right vertical portion 130*b*. The latching mechanism 100 further includes a left compression spring 120*a*, a right compression spring 120*b*, a left latching member 104*a*, and a right latching member 104*b*. The horizontal portion 103 defines a left through hole 128*a* and a right through hole 128*b*. The left and right through holes 128*a*, 128*b* are dimensioned and arranged to receive a mounting screw therethrough for coupling the latching mechanism 100 to a shade motor.

The left vertical portion 130*a* defines a left pin pocket stop 114*a* and a left through hole 132*a*. The left pin pocket stop 114*a* is dimensioned and arranged for receiving a left pin 116*a*. The left through hole 132*a* is dimensioned and arranged for receiving a left threaded pivot 122*a*. The left vertical portion 130*a* includes a left inside spring retention member 112*a* that defines a threaded hole 136*a* dimensioned and arranged for receiving a left spring retention screw 110*a*. The left vertical portion 130*a* further includes a left vertical portion guiding edge 126*a*.

The right vertical portion 130*b* defines a right pin pocket stop 114*b* and a right through hole 132*b*. The right pin pocket stop 114*b* is dimensioned and arranged for receiving a right pin 116*b*. The right through hole 132*b* is dimensioned and arranged for receiving a right threaded pivot 122*b*. The right vertical portion 130*b* includes a right inside spring retention member 112*b* that defines a threaded hole 136*b* dimensioned and arranged for receiving a right spring retention screw 110*b*. The right vertical portion 130*b* further includes a right vertical portion guiding edge 126*b*.

The left latching member 104*a* includes a left latching member actuating portion 108*a*, a left outside spring retention member 118*a*, a left curved portion 106*a*, a left latching member guiding edge 127*a*, and the left pin 116*a*. The left threaded pivot 122*a* may be a threaded stud that is affixed to the left latching member 104*a*. Alternatively, the left threaded pivot 122*a* may be a screw, and the left latching member 104*a* defines a threaded hole (not shown) dimensioned and arranged for receiving the screw therethrough.

The right latching member 104*b* includes a right latching member actuating portion 108*b*, a right outside spring retention member 118*b*, a right curved portion 106*b*, a right latching member guiding edge 127*b*, and the right pin 116*b*. The right threaded pivot 122*b* may be a threaded stud that is affixed to the right latching member 104*b*. Alternatively, the right threaded pivot 122*b* may be a screw, and the right latching member 104*b* defines a threaded hole (not shown) dimensioned and arranged for receiving the screw therethrough.

The left latching member 104*a* is coupled to the left vertical portion 130*a* by passing the left threaded pivot 122*a* through the left through hole 132*a* in the left vertical portion 130*a* and then securing the left latching threaded pivot 122*a* with a nut 134*a*. The left pin 116*a* is also disposed in the left pin pocket stop 114*a*. The left compression spring 120*a* is disposed between the left outside spring retention member 118*a* and the left inside spring retention member 112*a*. The spring retention screw 110*a* is secured in the threaded hole 136*a* in the left inside spring retention member 112*a* and is disposed into the left compression spring 120*a*.

The right latching member 104*b* is coupled to the right vertical portion 130*b* by passing the right threaded pivot 122*b* through the right through hole 132*b* in the right vertical portion 130*b* and then securing the right latching pivot screw 122*b* with a nut 134*b*. The right pin 116*b* is also disposed in the right pin pocket stop 114*b*. The right compression spring 120*b* is disposed between the right outside spring retention member 118*b* and the right inside spring retention member 112*b*. The spring retention screw 110*b* is secured in the threaded hole 136*b* and is disposed into the right compression spring 120*b*.

When the latching mechanism is assembled, the left curved portion 106*a* of the left latching member 104*a* and the guiding edge 127*a* of the left vertical portion 130*a* form an opening 124*a*, and the right curved portion 106*b* of the right latching member 104*b* and the guiding edge 127*b* of the right vertical portion 130*b* form an opening 124*b*. The left latching member 104*a* pivots (left or right) about the left threaded pivot 122*a*. The left pin pocket stop 114*a* restricts the range of movement of the left pin 116*a* and thereby limits the pivoting motion of the left latching member 104*a*. The right latching member 104*b* pivots (left or right) about the right threaded pivot 122*b*. The right pin pocket stop 114*b* restricts the range of movement of the right pin 116*b* and thereby limits the pivoting motion of the right latching member 104*b*.

Referring to FIG. 2, in one embodiment, an illustrative isometric projection of a dual shade motor bracket 200 with two shade latching mechanisms 100 disposed therein is shown. The dual shade motor bracket 200 defines a plurality of mounting through holes dimensioned and arranged to receive mounting screws therethrough for the purpose of securing the dual shade bracket 200 to a wall. The dual shade motor bracket 200 further defines a first opening 202*a* and a second opening 202*b*. The dual shade motor bracket 200 includes a first mounting pin 204*a* and a second mounting pin 204*b* disposed on opposite sides of the first opening 202*a*. The dual shade motor bracket 200 further includes a third mounting pin 204*c* and a fourth mounting pin 204*d* disposed on opposite sides of the first opening 202*b*. The mounting pins 204*a*, 204*b*, 204*c*, 204*d* are dimensioned and arranged to receive a latching shade mechanism 100, as described above.

In one embodiment, in operation, the latching mechanism 100 is mounted to a shade motor via through holes 128*a*, 128*b*. The shade motor is inserted into one end of a roller shade roller tube and an idler is inserted into the opposite end of the roller shade roller tube.

The idler includes an idler pin, which is then inserted into a mounted idler bracket. Thereafter, the side of the roller shade tube that includes the shade motor and coupled latching mechanism 100 is pushed toward a mounted roller shade motor bracket that includes a first mounting pin and a second mounting pin, as shown in FIG. 2.

Referring to FIGS. 1A-1B and 2, as the roller shade motor side of the roller shade is pushed into the motor bracket, the first mounting pin 204*a* contacts the left vertical portion guiding edge 126*a* (and the left latching member guiding edge 127*a*), and the second mounting pin 204*b* contacts the right vertical portion guiding edge 126*b* (and the right latching member guiding edge 127*b*). The first mounting pin 204*a* then pushes the left vertical portion guiding edge 126*a* and causes the left latching member 104*a* to pivot left (about the threaded pivot 122*a*) and compress the left compression spring 120*a* until the first mounting pin 204*a* slides into the left opening 124*a*. Concurrently, the second mounting pin 204*b* pushes the right vertical portion guiding edge 127*b* and causes the right latching member 104*b* to pivot right (about the threaded pivot 122*b*) and compress the right compression spring 120*b* until the second mounting pin 204*b* slides into the right opening 124*b*. Thereafter, the left spring 120*a* pushes the left latch member 104*a* to pivot right and retain the first mounting pin 204*a*, and the right spring 120*b* pushes the right latch member 104*b* to pivot left and retain the second mounting pin 204*b*. The amount of holding force of the latching mechanism 100 is determined by tension of the springs 120*a*, 120*b* and the weight of the roller shade.

To release the latching mechanism (i.e., unlatch the latching mechanism) from the first and second mounting pins 204*a*, 204*b*, the left latching member actuating portion 108*a* and the right latching member actuating portion 108*b* are simultaneously pushed (e.g., by a technician/installer) toward each other to compresses the left and right springs 120*a*, 120*b*, respectively. The spring compression causes the left latching member 104*a* to pivot left (about the threaded pivot 122*a*), and the right latching member 104*b* to pivot right (about the threaded pivot 122*b*) until both the left curved portion 127*a* and the right curved portion 127*b* move enough to allow first mounting member 204*a* to slide out of the left opening 124*a* and the second mounting member 204*b* to slide out of the right opening 124*b*.

Referring to FIG. 3, in another embodiment, an illustrative isometric projection of a shade latching apparatus/mechanism 300 is shown. Here, a single extension spring is used instead of the right and left springs of the embodiment shown in FIG. 1, and the pivoting motion of the latching members are limited by pins affixed to the frame.

The latching mechanism 300 includes a latching frame 302 which includes a horizontal portion 303, a left vertical portion 330*a*, and a right vertical portion 330*b*. The latching mechanism 300 further includes an extension spring 320, a left latching member 304*a*, and a right latching member 304*b*. The horizontal portion 303 defines a left through hole 328*a* and a right through hole 328*b*. The left and right through holes 328*a*, 328*b* are dimensioned and arranged to receive a mounting screw therethrough for coupling the latching mechanism 300 to a shade motor.

A left threaded pivot 322*a* may be a threaded stud that is affixed to the left vertical portion 330*a*. Alternatively, the left threaded pivot 322*a* may be a screw, and the left vertical portion 330*a* defines a left threaded hole (not shown) that is dimensioned and arranged for receiving the screw. The left vertical portion 330*a* includes a left pin 316*a* and a left vertical portion guiding edge 326*a*.

A right threaded pivot 322*b* may be a threaded stud that is affixed to the right vertical portion 330*b*. Alternatively, the right threaded pivot 322*b* may be a screw, and the right vertical portion 330*b* defines a right threaded hole (not shown) that is dimensioned and arranged for receiving the screw. The right vertical portion 330*b* includes a right pin 316*a* and a right vertical portion guiding edge 326*a*.

The left latching member 304*a* includes a left latching member actuating portion 308*a*, a left outside spring retention member 318*a*, a left curved portion 306*a*, and a left latching member guiding edge 327*a*. The left latching member 304*a* defines a through hole (not shown) dimensioned and arranged for receiving therethrough the left threaded pivot 322*a*. The left outside spring retention member 318*a* defines a through hole 332*a* dimensioned and arranged for receiving therethrough one end of the extension spring 320.

The right latching member 304*b* includes a right latching member actuating portion 308*b*, a right outside spring retention member 318*b*, a right curved portion 306*b*, and a right latching member guiding edge 327*b*. The right latching member 304*b* defines a through hole (not shown) dimensioned and arranged for receiving therethrough the right threaded pivot 322*b*. The right outside spring retention member 318*b* defines a through hole 332*b* dimensioned and arranged for receiving therethrough the other end of the extension spring 320.

The left latching member 304*a* is coupled to the left vertical portion 330*a* by passing the left threaded pivot 322*a* through a left through hole (not shown) in the latching member 304*a* and then securing the left threaded pivot 322*a* with a nut 334*a*.

The right latching member 304*b* is coupled to the right vertical portion 330*b* by passing the right threaded pivot 322*b* through a through hole (not shown) in the right latching member 304*b* and then securing the right threaded pivot 322*b* with a nut 334*a*.

When the latching mechanism 300 is assembled, the left vertical portion 330*a* and the left curved portion 306*a* form an opening 324*a*, and the right vertical portion 330*b* and right curved portion 306*b* form an opening 124*b*. The left latching member 304*a* pivots about the left threaded pivot 322*a*, and the right latching member 304*b* pivots about the right threaded pivot 322*b*. The left pin 316*a* limits the right pivotal motion of the left latching member 304*a*, and the right pin 316*b* limits the left pivotal motion of the right latching member 304*b*. One end of the extension spring 320 is disposed through the through hole 332*a*, and the other end of the extension spring 320 is disposed through the through hole 332*b*.

In one embodiment, in operation, the latching mechanism 300 is mounted to a shade motor via through holes 328*a*, 328*b*. The shade motor is inserted into one end of a roller shade roller tube and an idler is inserted into the opposite end of the roller shade roller tube. The idler includes an idler pin, which is then inserted into a mounted idler bracket. Thereafter, the side of the roller shade tube that includes the shade motor and coupled latching mechanism 300 is pushed toward a mounted roller shade motor bracket that includes a first mounting pin and a second mounting pin (see FIG. 2).

Similar to that described above with respect to FIGS. 1 and 2, and referring to FIG. 3, as the roller shade motor side of the roller shade is pushed into the motor bracket, a first mounting pin contacts the left vertical portion guiding edge 326*a* and the left latching member guiding edge 327*a*, and a second mounting pin contacts the right vertical portion guiding edge 326*b* and the right latching member guiding edge 327*b*. The first mounting pin pushes the left latching member 304*a* to pivot left (about the threaded pivot 322*a*) and extend the extension spring 320*a*, and the second mounting pin pushes right latching member 304*b* to pivot right (about the threaded pivot 322*b*) and also extend the extension spring 320*b* until the first mounting pin slides into the left opening 324*a* and the second mounting pin slides into the right opening 324*b*.

Thereafter, the extension spring 320 pulls the left latch member 104*a* to pivot right and latch the first mounting pin, and the extension spring 320 pulls the right latch member 304*b* to pivot left and latch the second mounting pin. The amount of holding force of the latching mechanism 300 is determined by the spring 320 and the weight of the roller shade.

To release the latching mechanism 300 (i.e., de-latch the latching mechanism) from the first and second mounting pins, the left latching member actuating portion 308*a* and the right latching member actuating portion 308*b* are simultaneously pushed (e.g., by a technician/installer) toward each other to simultaneously pivot the left and right latching members 304*a*, 304*b* away from each other and extend the extension spring 320 until both the left curved portion 327*a* and the right curved portion 327*b* move enough to allow left mounting member to slide out of the left opening 324*a* and the right mounting member to slide out of the right opening 324*b*.

In various embodiments, the latching mechanisms 100, 300 are made of aluminum, stainless steel, fiberglass, plastic, or any other suitable material known to those skilled in the art.

In the Décor version, the spring is extended by the latching operation. Once the shade is lifted into place, the spring forces the bracket to close on the pin. The amount of holding force is determined by the spring and the weight of the shade.

INDUSTRIAL APPLICABILITY

To solve the aforementioned problems, the present embodiments provide a roller shade latching apparatus that couples to a shade mounting bracket using spring-loaded latching members.

Alternate Embodiments

Alternate embodiments may be devised without departing from the spirit or the scope of the embodiments.

What is claimed is:

1. A latching apparatus, comprising:

(a) a latching frame having at least one end portion that includes a guiding edge;

(b) at least one latching member having a curved part and a guiding edge located at an outer end of the curved part, and being coupled at a pivot to the end portion such that the guiding edge and the curved part of the latching member face the guiding edge of the end portion, the curved part of the latching member and the guiding edge of the end portion forming an opening; and (c) at least one spring coupled at one end to the latching member such that the spring exerts a force that drives the curved part of the latching member about the pivot toward the guiding edge of the end portion; wherein (d) the guiding edge of the latching member is configured to guide an external mounting pin toward the opening in response to the mounting pin being pushed against the guiding edge of the latching member whereby the mounting pin initially causes the latching member to pivot away from the end portion until the mounting pin slides past the guiding edge of the latching member and is secured between the curved part of the latching member and the guiding edge of the end portion by the force exerted by the spring, wherein (i) the at least one end portion includes (A) a first end portion located at one end of the latching frame and having a guiding edge, and (B) a second end portion located at another end of the latching frame and having a guiding edge;

(ii) the at least one latching member includes (A) a first latching member having a curved part and a guiding edge located at an outer end of the curved part, the first latching member being coupled at a first pivot to the first end portion such that the guiding edge and the curved part of the first latching member face the guiding edge of the first end portion, the curved part of the first latching member and the guiding edge of the first end portion forming a first opening, and (B) a second latching member having a curved part and a guiding edge located at an outer end of the curved part, the second latching member being coupled at a second pivot to the second end portion such that the guiding edge and the curved part of the second latching member face the guiding edge of the second end portion, the curved part of the second latching member and the guiding edge of the second end portion forming a second opening.

2. The latching apparatus of claim 1, wherein (iii) the at least one spring includes (A) a first spring coupled at one end to the first latching member and at another end to the first end portion such that the first spring exerts a force that drives the curved part of the first latching member about the first pivot toward the guiding edge of the first end portion, and (B) a second spring coupled at one end to the second latching member and at another end to the second end portion such that the second spring exerts a force that drives the curved part of the second latching member about the second pivot toward the guiding edge of the second end portion; wherein (iv) the guiding edge of the first latching member is configured to guide an external first mounting pin toward the first opening in response to the first mounting pin being pushed against the guiding edge of the first latching member whereby the first mounting pin initially causes the first latching member to pivot away from the first end portion until the first mounting pin slides past the guiding edge of the first latching member and is secured between the curved part of the first latching member and the guiding edge of the first end portion by the force exerted by the first spring, and (v) the guiding edge of the second latching member is configured to guide an external second mounting pin toward the second opening in response to the second mounting pin being pushed against the guiding edge of the second latching member whereby the second mounting pin initially causes the second latching member to pivot away from the second end portion until the second mounting pin slides past the guiding edge of the second latching member and is secured between the curved part of the second latching member and the guiding edge of the second end portion by the force exerted by the second spring.

3. The latching apparatus of claim 1, wherein (iii) the at least one spring is a spring coupled at one end to the first latching member and at another end to the second latching member such that the spring exerts a force that drives the curved part of the first latching member about the first pivot toward the guiding edge of the first end portion and drives the curved part of the second latching member about the second pivot toward the guiding edge of the second end portion; wherein (iv) the guiding edge of the first latching member is configured to guide an external first mounting pin toward the first opening in response to the first mounting pin being pushed against the guiding edge of the first latching member whereby the first mounting pin initially causes the first latching member to pivot away from the first end portion until the first mounting pin slides past the guiding edge of the first latching member and is secured between the curved part of the first latching member and the guiding edge of the first end portion by the force exerted by the spring, and (v) the guiding edge of the second latching member is configured to guide an external second mounting pin toward the second opening in response to the second mounting pin being pushed against the guiding edge of the second latching member whereby the second mounting pin initially causes the second latching member to pivot away from the second end portion until the second mounting pin slides past the guiding edge of the second latching member and is secured between the curved part of the second latching member and the guiding edge of the second end portion by the force exerted by the spring.

4. A latching apparatus, comprising:

(a) a latching frame that includes a first end portion located at one end of the latching frame and a second end portion located at another end of the latching frame, each having a respective guiding edge;

(b) a first latching member having a curved part and a guiding edge located at an outer end of the curved part, the first latching member being coupled at a first pivot to the first end portion such that the guiding edge and the curved part of the first latching member face the guiding edge of the first end portion, the curved part of the first latching member and the guiding edge of the first end portion forming a first opening;

(c) a first spring coupled at one end to the first latching member and at another end to the first end portion such that the first spring exerts a force that drives the curved part of the first latching member about the first pivot toward the guiding edge of the first end portion, (d) a second latching member having a curved part and a guiding edge located at an outer end of the curved part, the second latching member being coupled at a second pivot to the second end portion such that the guiding edge and the curved part of the second latching member face the guiding edge of the second end portion, the curved part of the second latching member and the guiding edge of the second end portion forming a second opening;

(e) a second spring coupled at one end to the second latching member and at another end to the second end portion such that the second spring exerts a force that drives the curved part of the second latching member about the second pivot toward the guiding edge of the second end portion; wherein (f) the guiding edge of the first latching member is configured to guide a first mounting pin of an external bracket toward the first opening in response to the first mounting pin being pushed against the guiding edge of the first latching member whereby the first mounting pin initially causes the first latching member to pivot away from the first end portion until the first mounting pin slides past the guiding edge of the first latching member and is secured between the curved part of the first latching member and the guiding edge of the first end portion by the force exerted by the first spring, and (g) the guiding edge of the second latching member is configured to guide a second mounting pin of the external bracket toward the second opening in response to the second mounting pin being pushed against the guiding edge of the second latching member whereby the second mounting pin initially causes the second latching member to pivot away from the second end portion until the second mounting pin slides past the guiding edge of the second latching member and is secured between the curved part of the second latching member and the guiding edge of the second end portion by the force exerted by the second spring.

5. The latching apparatus of claim 4, further comprising (i) a first actuating portion configured to compress the first spring and cause the first latching member to pivot away from the first end portion in response to pressure being applied to the first actuating portion, and (ii) a second actuating portion configured to compress the second spring and cause the second latching member to pivot away from the second end portion in response to pressure being applied to the first actuating portion.

6. The latching apparatus of claim 5, wherein first and second actuating portions are configured to compress the first and second springs concurrently in response to pressure being concurrently applied to the first and second actuating portions.

7. The latching apparatus of claim 4, further comprising (i) a first motion limiting pin formed in one of the first latching member or the first end portion, and a first opening formed in another of the first latching member or the first end portion and that receives the first motion limiting pin, wherein motion of the first latching member about the first pivot is stopped by the first motion limiting pin contacting a wall of the first opening, and (ii) a second motion limiting pin formed in one of the second latching member or the second end portion, and a second opening formed in another of the second latching member or the second end portion and that receives the second motion limiting pin, wherein motion of the second latching member about the second pivot is stopped by the second motion limiting pin contacting a wall of the second opening.

8. A latching apparatus, comprising:

(a) a latching frame that includes a first end portion located at one end of the latching frame and a second end portion located at another end of the latching frame, each having a respective guiding edge;

(b) a first latching member having a curved part and a guiding edge located at an outer end of the curved part, the first latching member being coupled at a first pivot to the first end portion such that the guiding edge and the curved part of the first latching member face the guiding edge of the first end portion, the curved part of the first latching member and the guiding edge of the first end portion forming a first opening;

(c) a second latching member having a curved part and a guiding edge located at an outer end of the curved part, the second latching member being coupled at a second pivot to the second end portion such that the guiding edge and the curved part of the second latching member face the guiding edge of the second end portion, the curved part of the second latching member and the guiding edge of the second end portion forming a second opening;

(d) a spring coupled at one end to the first latching member and at another end to the second latching member such that the spring exerts a force that drives the curved part of the first latching member about the first pivot toward the guiding edge of the first end portion and drives the curved part of the second latching member about the second pivot toward the guiding edge of the second end portion; wherein (e) the guiding edge of the first latching member is configured to guide a first mounting pin of an external bracket toward the first opening in response to the first mounting pin being pushed against the guiding edge of the first latching member whereby the first mounting pin initially causes the first latching member to pivot away from the first end portion until the first mounting pin slides past the guiding edge of the first latching member and is secured between the curved part of the first latching member and the guiding edge of the first end portion by the force exerted by the spring, and (f) the guiding edge of the second latching member is configured to guide a second mounting pin of the external bracket toward the second opening in response to the second mounting pin being pushed against the guiding edge of the second latching member whereby the second mounting pin initially causes the second latching member to pivot away from the second end portion until the second mounting pin slides past the guiding edge of the second latching member and is secured between the curved part of the second latching member and the guiding edge of the second end portion by the force exerted by the spring.

9. The latching apparatus of claim 8, wherein (i) the first latching member includes a first actuating portion, and (ii) the second latching member includes a second actuating portion, wherein (iii) the first actuating portion and the second actuating portion are configured to compress the spring and cause the first and second latching members to pivot away from the latching frame in response to pressure being concurrently applied to the first and second actuating portions.

10. The latching apparatus of claim 8, further comprising (i) a first motion limiting pin formed in the first end portion of the latching frame, wherein motion of the first latching member about the first pivot is stopped by the first latching member contacting the first motion limiting pin, and (ii) a second motion limiting pin formed in the second end portion of the latching frame, wherein motion of the second latching member about the second pivot is stopped by the second latching member contacting the second motion limiting pin.

11. A latching system, comprising:

(a) a bracket including a first mounting pin and a second mounting pin; and (b) a latching apparatus, comprising:

(i) a latching frame that includes a first end portion located at one end of the latching frame and a second end portion located at another end of the latching frame, each having a respective guiding edge, (ii) a first latching member having a curved part and a guiding edge located at an outer end of the curved part, the first latching member being coupled at a first pivot to the first end portion such that the guiding edge and the curved part of the first latching member face the guiding edge of the first end portion, the curved part of the first latching member and the guiding edge of the first end portion forming a first opening, (iii) a first spring coupled at one end to the first latching member and at another end to the first end portion such that the first spring exerts a force that drives the curved part of the first latching member about the first pivot toward the guiding edge of the first end portion, (iv) a second latching member having a curved part and a guiding edge located at an outer end of the curved part, the second latching member being coupled at a second pivot to the second end portion such that the guiding edge and the curved part of the second latching member face the guiding edge of the second end portion, the curved part of the second latching member and the guiding edge of the second end portion forming a second opening, (v) a second spring coupled at one end to the second latching member and at another end to the second end portion such that the second spring exerts a force that drives the curved part of the second latching member about the second pivot toward the guiding edge of the second end portion, wherein (vi) the guiding edge of the first latching member is configured to guide the first mounting pin of the bracket toward the first opening in response to the first mounting pin being pushed against the guiding edge of the first latching member whereby the first mounting pin initially causes the first latching member to pivot away from the first end portion until the first mounting pin slides past the guiding edge of the first latching member and is secured between the curved part of the first latching member and the guiding edge of the first end portion by the force exerted by the first spring, and (vii) the guiding edge of the second latching member is configured to guide the second mounting pin of the bracket toward the second opening in response to the second mounting pin being pushed against the guiding edge of the second latching member whereby the second mounting pin initially causes the second latching member to pivot away from the second end portion until the second mounting pin slides past the guiding edge of the second latching member and is secured between the curved part of the second latching member and the guiding edge of the second end portion by the force exerted by the second spring.

12. A latching system, comprising:

(a) a bracket including a first mounting pin and a second mounting pin; and (b) a latching apparatus, comprising:

(i) a latching frame that includes a first end portion located at one end of the latching frame and a second end portion located at another end of the latching frame, each having a respective guiding edge;

(ii) a first latching member having a curved part and a guiding edge located at an outer end of the curved part, the first latching member being coupled at a first pivot to the first end portion such that the guiding edge and the curved part of the first latching member face the guiding edge of the first end portion, the curved part of the first latching member and the guiding edge of the first end portion forming a first opening;

(iii) a second latching member having a curved part and a guiding edge located at an outer end of the curved part, the second latching member being coupled at a second pivot to the second end portion such that the guiding edge and the curved part of the second latching member face the guiding edge of the second end portion, the curved part of the second latching member and the guiding edge of the second end portion forming a second opening;

(iv) a spring coupled at one end to the first latching member and at another end to the second latching member such that the spring exerts a force that drives the curved part of the first latching member about the first pivot toward the guiding edge of the first end portion and drives the curved part of the second latching member about the second pivot toward the guiding edge of the second end portion; wherein (v) the guiding edge of the first latching member is configured to guide the first mounting pin of the bracket toward the first opening in response to the first mounting pin being pushed against the guiding edge of the first latching member whereby the first mounting pin initially causes the first latching member to pivot away from the first end portion until the first mounting pin slides past the guiding edge of the first latching member and is secured between the curved part of the first latching member and the guiding edge of the first end portion by the force exerted by the spring, and (vi) the guiding edge of the second latching member is configured to guide the second mounting pin of the bracket toward the second opening in response to the second mounting pin being pushed against the guiding edge of the second latching member whereby the second mounting pin initially causes the second latching member to pivot away from the second end portion until the second mounting pin slides past the guiding edge of the second latching member and is secured between the curved part of the second latching member and the guiding edge of the second end portion by the force exerted by the spring.

* * * * *